US006230513B1

(12) United States Patent
Reinmuth

(10) Patent No.: US 6,230,513 B1
(45) Date of Patent: May 15, 2001

(54) WATER COOLER AND DISPENSER

(76) Inventor: Jonathan E. Reinmuth, 7318 Hermitage Rd., Richmond, VA (US) 23228

( * ) Notice: Subject to any disclaimer, the term of this patent is extended or adjusted under 35 U.S.C. 154(b) by 0 days.

(21) Appl. No.: 09/525,120

(22) Filed: Mar. 14, 2000

(51) Int. Cl.[7] ..... B67D 5/62

(52) U.S. Cl. ..... 62/399; 62/390; 62/398; 222/146.6

(58) Field of Search ..... 62/399, 400, 396, 62/398, 390; 165/163; 222/146.6

(56) References Cited

U.S. PATENT DOCUMENTS

| | | | | |
|---|---|---|---|---|
| 2,871,675 | | 2/1959 | Cornelius . | |
| 3,865,276 | * | 2/1975 | Thompson . | |
| 4,407,356 | | 10/1983 | DeLau . | |
| 4,462,220 | * | 7/1984 | Lannelli | 165/163 X |
| 4,491,244 | | 1/1985 | Yanes . | |
| 4,856,678 | | 8/1989 | Stanfill et al. . | |
| 5,129,552 | * | 7/1992 | Painchaud et al. | 222/146.6 |
| 5,226,296 | * | 7/1993 | Kolvites et al. | 62/390 X |
| 5,350,086 | | 9/1994 | Martin et al. . | |
| 5,743,107 | | 4/1998 | Kyees . | |
| 5,803,163 | | 9/1998 | Goulet . | |
| 6,105,825 | * | 8/2000 | Gomi et al. | 222/146.6 |

* cited by examiner

*Primary Examiner*—Michael Buiz
*Assistant Examiner*—Chen-Wen Jiang
(74) *Attorney, Agent, or Firm*—Norman B. Rainer

(57) ABSTRACT

A semi-portable water cooler suitable for outdoor use on a sports playing field includes a thermally insulated container supplied with water such as from a municipal water supply by way of a feeder hose. A spiraled water conduit tube is emplaced within the container which is filled with ice. Water received from the feeder hose passes upwardly through the tube and exits from a cover at the top of the container. The cooled exiting water is fed into a number of separate exterior lengths of flexible hose, each terminating in a valve-controlled drinking spout. The spouts with attached hoses are held by brackets supported by the container, and are slideably retained while permitting lifting to drinking height for a standing person.

12 Claims, 3 Drawing Sheets

WATER COOLER AND DISPENSER

BACKGROUND OF THE INVENTION

1. Field of the Invention

This invention concerns apparatus for cooling drinking water and dispensing a large volume of said cooled water to a number of individuals simultaneously.

2. Description of the Prior Art

In the course of athletic competition, particularly outdoors on hot days, players need to drink a cooled beverage to avoid dehydration and help cool the body. In certain sports such as soccer, football and lacrosse, the number of participants is large. Therefore, the volume of beverage needed at the sites where these events occur is also large. The most universally accepted cold beverage is water, and the dispenser should be sufficiently portable to be taken out to the field to service the players.

Numerous portable devices have been disclosed for cooling beverages. Such devices generally employ a thermally insulated container which holds ice. In the simplest of such devices cooler chests are employed wherein bottles or cans of beverages are stored in contact with ice cubes and are removed as needed by way of a closure lid. In other devices, a coiled tube is disposed within a compartment filled with ice, preferably in cube or crushed form, and water is run through the tube toward a dispensing extremity. Such construction is shown for example in U.S. Pat. No. 4,407,356 to DeLau wherein water is caused to flow by gravity from a top reservoir through a cooling coil to a lower spigot. The DeLau cooler unit is limited in its capacity by the size of the reservoir. If the reservoir is made larger, the considerable weight of the water compromises the portability of the unit. Also, the low position of the spigot necessitates the use of a table, upon which the cooler would be placed, and cups to receive the cooled water. Other portable cooling devices equipped with coils through which the beverage travels are disclosed in U.S. Pat. Nos. 2,871,675; 4,856,678; 5,350,086; 5,743,107; 5,803,163.

However, such devices in general have limited beverage capacity and lack sufficient portability to be carried or wheeled outdoors to a playing field. Also, the dispensers usually service just one player at a time, and necessitate the inconvenience of having to use drinking cups.

In order to permit multiple dispensing ports while obviating the need for drinking cups, portable water coolers have been disclosed having flexible drinking spouts disposed above the cooling chamber. However, such units require pumped pressurization to drive the water to heights above the cooling chamber. Such pressuization, when achieved by a hand-operated pump causes the dispenser to be difficult to use. When a battery-operated pump is employed, the dispenser becomes expensive and problematic. The battery must be frequently re-charged, and both the battery and pumping mechanism are subject to failure. Furthermore, the pressurization mechanism, often associated with an upper lid of the cooling compartment, causes difficulties in adding fresh ice to the cooling compartment. In general, most prior water coolers intended for semi-portable outdoor use have a limited capacity, requiring manual addition of drinking water.

It is accordingly an object of the present invention to provide a water cooler having an unlimited water supply while still being sufficiently portable to permit movement onto a playing field.

It is another object of this invention to provide a water cooler as in the foregoing object which can service several drinkers at the same time.

It is a further object of the present invention to provide a water cooler of the aforesaid nature which dispenses cooled water without the need for a drinking cup to receive and drink the dispensed water.

It is yet another object of this invention to provide a water cooler of the aforesaid nature which permits easy ice replacement.

It is an additional object of the present invention to provide a water cooler of the aforesaid nature which enables the ice to efficiently cool the water.

It is still another object of this invention to provide a water cooler of the aforesaid nature of lightweight, durable construction amenable to low cost manufacture.

These objects and other objects and advantages of the invention will be apparent from the following description.

SUMMARY OF THE INVENTION

The above and other beneficial objects and advantages are accomplished in accordance with the present invention by a portable water cooler comprising:

a) a thermally insulated container comprised of a circular cylindrical sidewall, a flat bottom panel integral with said sidewall and defining therewith an interior region, a removable circular top cover having a center first aperture, and a second aperture disposed in said sidewall adjacent said bottom panel and equipped with an exterior fluid coupling fitting, b) a length of tubing disposed within said container and shaped in part as a uniform spiral coil that lies closely adjacent said sidewall, said tubing having an entrance extremity that communicates with said second aperture, and an exit extremity located within said interior region adjacent said top cover, c) an interior length of flexible hose extending in leak proof joinder between said exit extremity and said first aperture, d) a multi-port fluid diverting fixture associated with said first aperture, e) an exterior length of flexible hose coupled to each port of said fixture and terminating in a distal extremity, f) a spout attached to each distal extremity and comprised of a squeeze-controlled valve and associated discharge nozzle, and a cup-shaped spacer disposed upon said nozzle in a manner to prevent lip contact of the nozzle by the drinker, g) a service bracket attached to said top cover and extending upwardly therefrom in an inverted U-shape configuration, and h) holder means disposed upon said bracket for securing said spouts and permitting slidable upward deployment of said exterior lengths of flexible hose.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
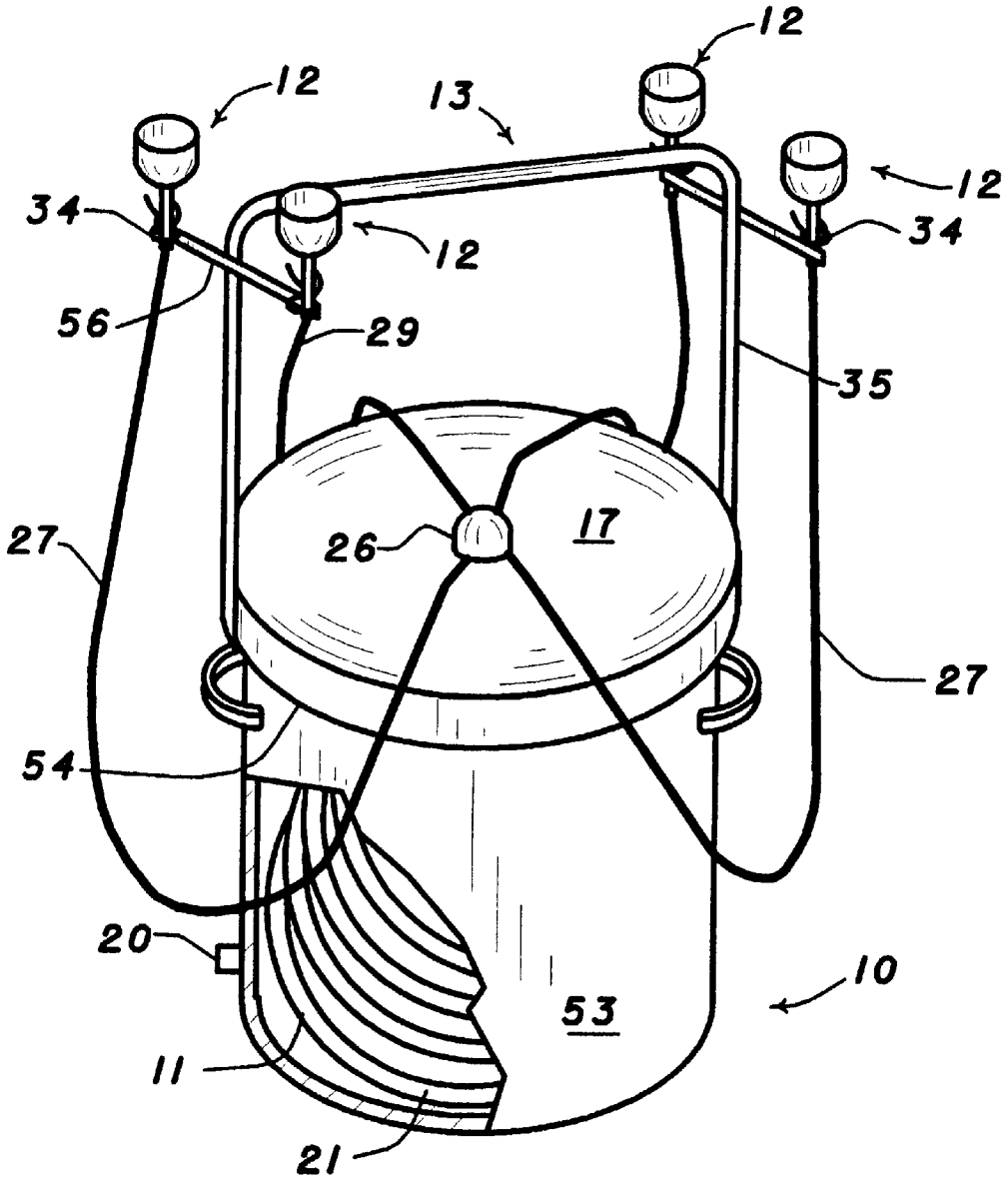
FIG. 1 is a perspective front view of an embodiment of the water cooler of the present invention, with portions broken away to reveal interior details.
Figure 2:
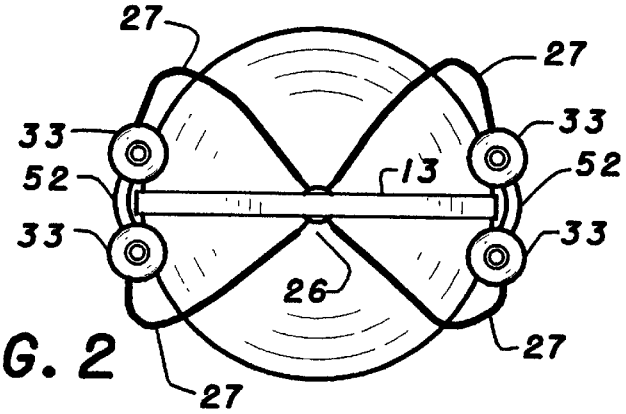
FIG. 2 is a top view of the embodiment of FIG. 1.
Figure 3:
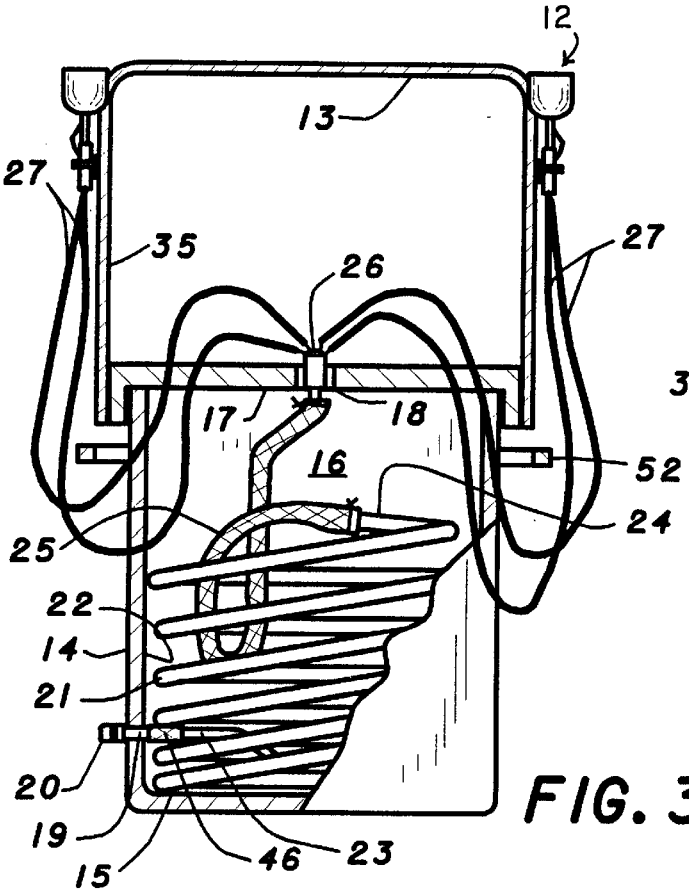
FIG. 3 is a side view with portions broken away.
Figure 4:
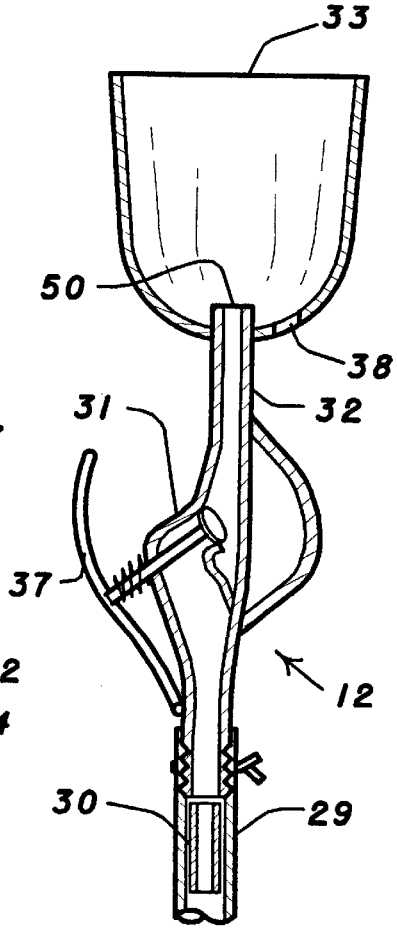
FIG. 4 is an enlarged sectional view of the spout component of the embodiment of FIG. 1.
Figure 5:
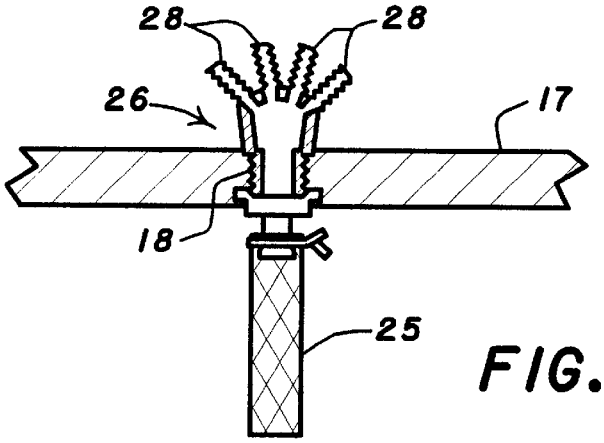
FIG. 5 is an enlarged sectional view of a multi-port fluid diverting fixture which may be used in the embodiment of FIG. 1.

Referring now to FIGS. 1–6, an embodiment of the water cooler of the present invention is shown comprised of a thermally insulated container 10 having internal coiled tubing 11, and four lengths of exterior flexible plastic hose 27 emergent from said container and terminating in spouts 12 supported by service bracket 13.

Container 10 is comprised of circular cylindrical sidewall 14, flat bottom panel 15 integral with said sidewall and defining therewith an interior region 16, and removable circular top cover 17. Said top cover is provided with a centered first aperture 18. A second aperture 19 is disposed in said sidewall adjacent said bottom panel, and is equipped with an exterior fluid coupling fitting 20. Suitable containers for use in the present invention include those currently available as coolers for bottled and can beverages, and are generally of double-wall plastic construction having thermal insulation between the walls. Laterally opposed carrying handles 52 are usually incorporated into the exterior surface 53 of sidewall 14 adjacent its upper extremity 54.

Tubing 11 is preferably fabricated of copper and may have an inside diameter between about ¼" and ½" Said tubing is in the shape of a uniform self-supporting spiral coil 21 that lies closely adjacent or in contact with the interior surface 22 of sidewall 14. Said tubing has an entrance extremity 23 that communicates with said second aperture, and an exit extremity 24 located within interior region 16 adjacent top cover 17. An interior length of flexible hose 25 extends in leak-proof joinder between the exit extremity of said tubing and said first aperture in top cover 17. The length of hose 25 must be at least a foot long and may be up to three feet in length in order to permit removal of cover 17 without disconnecting said hose from tubing 11. Entrance extremity 23 is preferably at an elevation at least as high as said second apertures thereby enabling gravity-aided drainage of water from coil 21 for storage purposes. In some embodiments a stand or spacer may be positioned on bottom panel 15 to produce the desired elevation of the coil.

A multi-port fluid diverting fixture 26 is coupled to said first aperture. An exterior length of flexible hose 27 is connected to each port 28 of fixture 26, and terminates in a distal extremity 29 which preferably contains flow restricting means in the form of channeled plug 30. The length of exterior hose 27 is at least three feet, thereby enabling the hose to lie in a looped configuration permitting upward extension to a standing drinker.

A spout 12 is associated with the distal extremity 29 of each exterior length of hose 27. Said spout is comprised of a squeeze-controlled valve 31 and associated discharge nozzle 32. A bell-shaped spacer 33 is secured to the nozzle The size and shape of the spacer is such that it prevents lip contact of the nozzle by the drinker. The exit diameter 50 of nozzle 32 is preferably larger than the effective diameter of plug 30, thereby permitting the water emergent from the nozzle to have reduced force relative to the unrestrained force that would otherwise result. The number of spouts that may be employed is between about 4 and 8.

Service bracket 13, having an inverted U-shape, is attached to top cover 17 and extends upwardly therefrom by a height of 15 to 30 inches. Holder arms 56 extend outwardly from the upright arms 35 of bracket 13 and contain retainer loops 34.. Said loops secure spouts 12 while permitting slidable upward deployment of said exterior lengths of hose 27. In the exemplified embodiment, service bracket 13 is of flat metal construction, and is attached as by bolting to the sidewall of top cover 17. In alternative embodiments, service bracket 13 may be removably attached to top cover 17 by engagement with the top and/or sidewall portions of said cover. Also, the service bracket may have configurations other than U-shaped.

Figure 6:
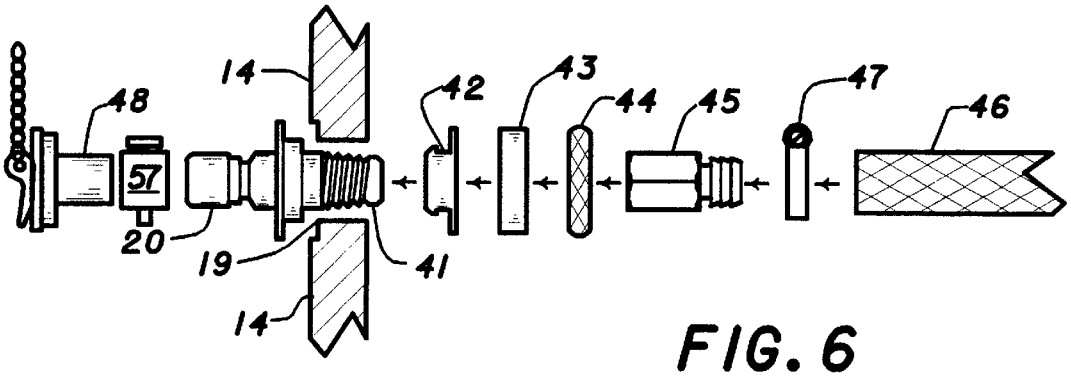
FIG. 6 is an enlarged exploded side view of the exterior fluid coupling fitting of the embodiment of FIG. 1.

Referring now to FIG. 6, fluid coupling fitting 20 is shown to be of the quick-disconnect type wherein joinder and separation of an associated garden hose equipped with a compatible fitting is achieved by axial movement of the joining components. A threaded collar 41 causes fitting 20 to seat within second aperture 19. A rubber washer 42, spacer 43 and securing nut 44 are applied to collar 41 from interior region 16 in a manner to cause leak-proof engagement of fitting 20 with sidewall 14. A threaded hose barb adapter 45 is secured onto collar 41. A flexible connector hose 46 which extends from the entrance extremity 23 of tubing 11 is frictionally pressed onto adapter 45 and secured thereupon by hose clamp 47. By virtue of such arrangement of components, the coil of tubing 11 may be removed from said container for servicing and/or cleaning. A plug 48 may be tethered to the exterior of sidewall 14 for the purpose of preventing leakage from the coil when the cooler is stored. A bypass valve 57 may be associated with fitting 20 to permit water from a supply garden hose to be initially discharged, particularly if said water has been lying stagnant within the garden hose on a hot day, and thereby heated.

In use, container 10 is filled with ice in cube or comminuted form, and a conventional garden hose, not a part of this invention, is connected to fitting 20. The water which supplies the garden hose, generally a municipal water supply having a pressure of 40–60 psi, is turned on. The cooler can be carried or wheeled to a location on a field which may be adjacent the sidelines. In this regard, the cooler of this invention is deemed to be "semi-portable." The range of placement of the cooler is dependent upon the length of the garden hose. Stagnant warm water in the garden hose is dumped via valve 57 prior to use. The player seeking a drink grasps the spout, lifts it upward to drinking height and squeezes the trigger lever 37 that activates valve 31. The spout is held so that the nozzle is upwardly directed. The flow of water through the nozzle is controlled by restricting means 30 so that a stream is produced having a height slightly greater than the length of spacer 33. This mode of operation obviates the need for the drinker to place his lips on spacer 33, thus creating a sanitary drinking situation. Holes 38 in the bottom of spacer 33 prevent the unwanted accumulation of water in said spacer. The exact height of the stream of water emergent from the nozzle is adjusted by proper, choice of restricting means 30 in conjunction with existing municipal water pressure. Suitable flexible hoses useful in the cooler of this invention include, for example, plasticized polyvinyl chloride reinforced with braided fiberglass.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A water cooler comprising:

a) a thermally insulated container comprised of a circular cylindrical sidewall, a flat bottom panel integral with said sidewall and defining therewith an interior region, a removable circular top cover having a center first aperture, and a second aperture disposed in said sidewall adjacent said bottom panel and equipped with an exterior fluid coupling fitting, b) a length of tubing disposed within said container and shaped in part as a spiral coil that lies closely adjacent said sidewall, said tubing having an entrance extremity that communicates with said second aperture, and an exit extremity located within said interior region adjacent said top cover, c) an interior length of flexible hose extending in leak proof joinder between said exit extremity and said first aperture, d) a multi-port fluid diverting fixture associated with said first aperture, e) an exterior length of flexible hose coupled to each port of said fixture and terminating in a distal extremity, f) a spout attached to each distal extremity and comprised of a squeeze-controlled valve and associated discharge nozzle, and a cup-shaped spacer disposed upon said nozzle in a manner to prevent lip contact of the nozzle by a drinker, g) a service bracket attached to said top cover and extending upwardly therefrom, and h) holder means disposed upon said bracket for securing said spouts and permitting slidable upward deployment of said exterior lengths of flexible hose.

2. The water cooler of claim 1 wherein the length of said interior length of flexible hose is sufficient to permit removal of said cover without disconnecting said interior flexible hose from said spiral coil.

3. The water cooler of claim 2 wherein said interior length of flexible hose is between 1 and 3 feet.

4. The water cooler of claim 1 wherein the entrance extremity of said spiral coil is at an elevation at least as high as said second aperture.

5. The water cooler of claim 1 wherein said spouts number between 4 and 8.

6. The water cooler of claim 1 wherein said service bracket is of inverted U-shaped shape.

7. The water cooler of claim 1 wherein a flexible connector hose communicates between the entrance extremity of said spiral coil and said exterior fluid coupling fitting.

8. The water cooler of claim 1 wherein said fluid coupling fitting includes a quick-disconnect feature wherein joinder and separation with a compatible fitting is achieved by axial movements of the joining components.

9. The water cooler of claim 1 further comprising a plug for said fluid coupling fitting, said plug tethered to the sidewall of said container.

10. The water cooler of claim 1 further comprising a bypass valve associated with said exterior fluid coupling fitting and adapted to controllably divert water otherwise intended to enter said exterior fluid coupling fitting.

11. The water cooler of claim 1 further comprising flow restricting means active between each exterior length of flexible hose and its associated spout.

12. The water cooler of claim 1 wherein two holder means are disposed upon said bracket in diametrically opposed relationship.

* * * * *